US005219367A

United States Patent [19]

Fields

[11] Patent Number: 5,219,367

[45] Date of Patent: Jun. 15, 1993

[54] FIREFIGHTER'S TURNOUT PANTS

[75] Inventor: Ronald L. Fields, Winchester, Ky.

[73] Assignee: Lion Apparel, Inc., Dayton, Ohio

[21] Appl. No.: 841,400

[22] Filed: Feb. 25, 1992

[51] Int. Cl.[5] ..... A41D 13/00

[52] U.S. Cl. ..... 2/227; 2/81; 2/79; 2/85

[58] Field of Search ..... 2/227, 81, 79, 85

[56] References Cited

U.S. PATENT DOCUMENTS

| | | | |
|---|---|---|---|
| 331,959 | 12/1885 | Goldsmith | 2/227 |
| 1,082,213 | 12/1913 | Robinson | 2/2.1 A |
| 1,827,585 | 10/1931 | Kautz | 2/227 |
| 2,127,355 | 8/1938 | Grundstrom | 2/227 |
| 3,534,406 | 10/1968 | Barthlome | 2/2.1 A |
| 4,091,464 | 5/1978 | Vykukal | 2/2.1 A |
| 4,091,465 | 5/1978 | Webbon et al. | 2/2.1 A |
| 4,146,933 | 4/1979 | Jenkins et al. | 2/2 |
| 4,509,213 | 4/1985 | Harvey | 2/22 |
| 4,543,670 | 10/1985 | Ehring | 2/85 |
| 4,599,075 | 7/1986 | Nygard | 2/2.1 A |
| 4,608,716 | 9/1986 | Brumfield | 2/2.5 |
| 4,631,753 | 12/1986 | Ehring | 2/85 |
| 4,722,099 | 2/1988 | Kratz | 2/79 |
| 4,782,534 | 11/1988 | Grilliot et al. | 2/81 |
| 4,843,646 | 7/1989 | Grilliot et al. | 2/81 |
| 4,922,552 | 5/1990 | Grilliot et al. | 2/227 |
| 5,031,242 | 7/1991 | Aldridge et al. | 2/227 |
| 5,038,408 | 8/1991 | DeBaene | 2/227 |
| 5,072,454 | 12/1991 | Trahan | 2/81 |

*Primary Examiner*—Clifford D. Crowder
*Assistant Examiner*—Gloria Hale
*Attorney, Agent, or Firm*—Killworth, Gottman, Hagan & Schaeff

[57] ABSTRACT

A firefighter's turnout apparel comprises a pair of pants wherein knee joint areas of lower leg sections are formed to include bellows at the bend of the knee joints for increased protection, flexion range, and comfort. The bellows interconnect material above and below the joint sections to reduce tightness at the outside of the joint areas and material bunching at the inside of the joint areas, permitting freer flexibility and reduced compression of thermal material. Added material in the bellows which extends around the outer joint area, produces a slight bend in the material at these points results in the turnout apparel having a more natural and comfortable shape through the knee joint region, improving the thermal protection due to the reduced compression. Additional thermal protection is provided by inclusion of an additional thermal layer in the bellows. In addition to improved thermal protection, the bellows reduce cuff travel of the pants to provide better protection of the ankle areas.

17 Claims, 3 Drawing Sheets

FIREFIGHTER'S TURNOUT PANTS

BACKGROUND OF THE INVENTION

The present invention relates generally to protective clothing for firefighters and, more particularly, to an improved bellows arrangement for the knee joint region of firefighters pants.

Firefighting is very physically demanding work which must be performed under stressful conditions even in the best of circumstances. It is essential for firefighters to wear clothing which protects them from the hazards of the fire environment, while still allowing freedom of movement, particularly in the knee joint region. Firefighter's apparel most often consists of a long-sleeved turnout coat and full length turnout pants made of layers including a flame and heat resistant layer, a moisture barrier layer, and a thermal barrier layer. The sleeves and pant legs of prior art turnout apparel provide excellent protection when firefighters are standing upright with their arms straight.

Many duties of a firefighter require flexion in the knee joint areas, however. Unfortunately, in prior art turnout apparel, tightness is produced across the outside of the knee joint when the joint is flexed. This tightness compresses the thermal liner and reduces the thermal protection of the clothing in the flexed region. Further, this tightness combined with the bunching of material at the inside of the joint reduces the range of flexion of the knee joint. Additionally, the force required to bend the joint is increased, while complete flexion of the knee joint is impaired. Finally, there is a relatively high amount of cuff travel when knee joints are flexed, increasing the risk of exposure to fire hazards.

Aldridge et al, U.S. Pat. No. 5,031,242, (the '242 patent) disclose improvements in firefighter's turnout apparel including elbow and knee joint sections formed to include bellows at the bend of the elbow and knee joints for increased protection, flexion range, and comfort. The bellows disclosed in the '242 patent include a generally elliptical section extending halfway around the leg across the front or outside of the knee, producing a slight bend in the legs of the turnout pants at the knee to reduce material tightness when the knee is bent. In accordance with the '242 patent, a generally rectangular band portion may be added to the bellows section to extend across the back or inside of the knee joint, so the bellows and the generally rectangular portion together form a band that encircles the entire knee joint The generally elliptical section is, at any rate, sewn to upper and lower halves of each pant leg which cover the upper and lower leg, respectively, and covers a limited area therebetween.

The manufacture of knee bellows in accordance with the '242 patent produces a superior product having significant advantages, but is time-consuming and expensive. In particular, the curved, lower edge of the generally elliptical section of the knee bellows is difficult, time-consuming and expensive to manufacture.

Accordingly, there is a need for improved, cost-effective turnout apparel which facilitates joint flexion by substantially reducing the tightness on the outside of the flexed joint, compression of the thermal barrier, and the amount of sleeve and/or pant cuff travel, without decreasing the thermal protection provided to the firefighter at the joint regions. Improvements in the design of firefighter turnout apparel provide more comfort and permit freer mobility while requiring less work to bend joints, and the availability of affordable turn-out apparel with such improvements permits the provision of better protection for firefighters.

SUMMARY OF THE INVENTION

The present invention solves the problems existing in prior art turnout apparel by providing a cost-effective design which produces a bellows at the knee joint regions of turnout apparel which has increased protection, flexion range, and comfort, and which may be manufactured with greater ease. The knee joint bellows provided by the structure disclosed herein is oversized and adds a more natural shape to the knee joint regions by producing a slight bend in these regions. This slight bend permits the knee joint region to be flexed without substantially tightening the material across the outside of the joints or bunching up the material at the inside of the joints, and also without reducing the thermal protection barrier in those regions.

In fact, the bellows of the present invention further includes an additional layer of material for added thermal protection. The oversized character of the bellows allows this additional thermal barrier layer to be added to the inside of the existing thermal barrier layer, again, without causing tightness on the outside of the knee joint, or bunching up of material at the inside of the knee joint.

Typically, firefighter's turnout pants comprise a waist portion and two full length leg portions formed as straight cylinders from single pieces of material. In accordance with the present invention, each leg portion is made from substantially two pieces, an upper leg portion and a lower leg portion, seamed together above the knee, wherein the bellows is produced integral with the lower leg section, and results from the combination and seaming of patterns disclosed herein. In the preferred embodiment of this invention, the bellows is oversized, and is defined as an area including a semi-elliptical upper portion continuous with a generally rectangular lower portion in the knee region, and is constructed with extra material in all layers of the turnout pants, thereby substantially reducing the tightness on the outside of the knee joints, and the compression in all layers when the joints are flexed. The bellows is preferably continuous with all layers of the lower leg section. The knee bellows extend side to side, approximately halfway around the leg across the front or outside of the knee joint and a portion of the lower leg. The bellows, thus, cover approximately the front half of the total knee joint area and a portion of the front of the lower leg, producing a slight bend in the legs of the turnout pants at the knees.

To reduce material tightness when the knee is flexed, the bellows are wider at the middle to eliminate pulling and tightness at the front, and narrower along the sides to reduce material bunching at the sides and back. A radial seam along the upper edge of the semi-elliptical portion of the bellows provides a gusset that the knee falls into when the knee joint is flexed. The bottom "edge" of the generally rectangular portion of the bellows is positioned well below the knee to permit crawling, climbing and bending without interference from the seam, but sufficiently above the cuff to prevent cuff travel.

Preferably, the oversized bellows covering the knee joint areas are defined as having a maximum height at the apex of the semi-elliptically shaped portion to the bottom of the generally rectangularly shaped portion of approximately 10 inches, and having a width of approximately 11 inches along the bottom edge of the generally rectangular portion. The bellows are further defined as having a height of approximately 7 inches at the sides of the generally rectangular portion. The bellows preferably provide not less than an additional 1½ of material to receive the apex of the knee. The inclusion of a second thermal layer, and/or the addition of an outer patch to the bellows, described further below, encompasses this defined bellows area.

The preferred embodiment of the present invention, includes an additional thermal protection layer in the bellows to provide added thermal protection to the knee when the firefighter is standing and, in particular, when the bellows is compressed by the knee joint, as for example, when the firefighter is crawling. This additional thermal protection layer further provides added shock and impact protection to the knee joint, again, particularly, when the bellows is compressed by the knee joint, as when the firefighter is crawling.

In addition, an oversized, generally semi-elliptically shaped patch may be attached over the bellows area as an additional, outside layer of the bellows to extend the wear life and reduce compression burns. The patch also provides additional padding for shock or impact resistance, and may be made either of leather, which is preferred, or may be made of the same material as the outer flame and heat resistant layer of the pants.

It is, accordingly, an object of the present invention to provide improved firefighter turnout pants to enable firefighters to more comfortably and easily flex their knee joints while wearing the turnout pants; and, to provide improved firefighter turnout pants wherein additional material is provided by improved bellows located within the knee joint portions of the pant legs to increase the fullness and flexibility of the front or outer knee joint region. It is a further object of the present invention to provide an improved, more cost-effective, firefighter's turnout pants wherein an oversized bellows of generally semi-elliptical bellow shape is continuous with the lower pant leg, and connects to the upper pant leg to produce a more cost-effective garment than existing turnout pants by eliminating seams; and, to provide improved firefighter turnout pants wherein an additional material layer is provided in the knee joint bellows for improved thermal protection of firefighters.

Other objects and advantages of the invention will be apparent from the following description, the accompanying drawings, and the appended claims.

DETAILED DESCRIPTION OF THE INVENTION

Figure 1:
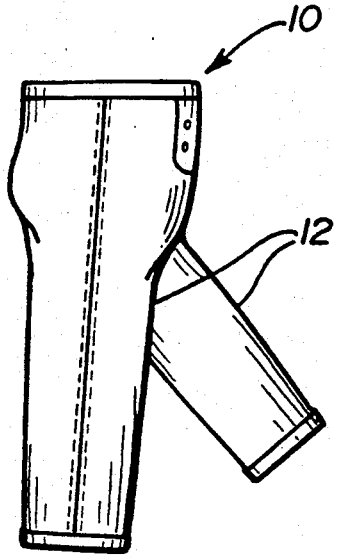
FIG-1 PRIOR ART
FIG. 1 is a side view of prior art firefighter turnout pants.
Figure 2:
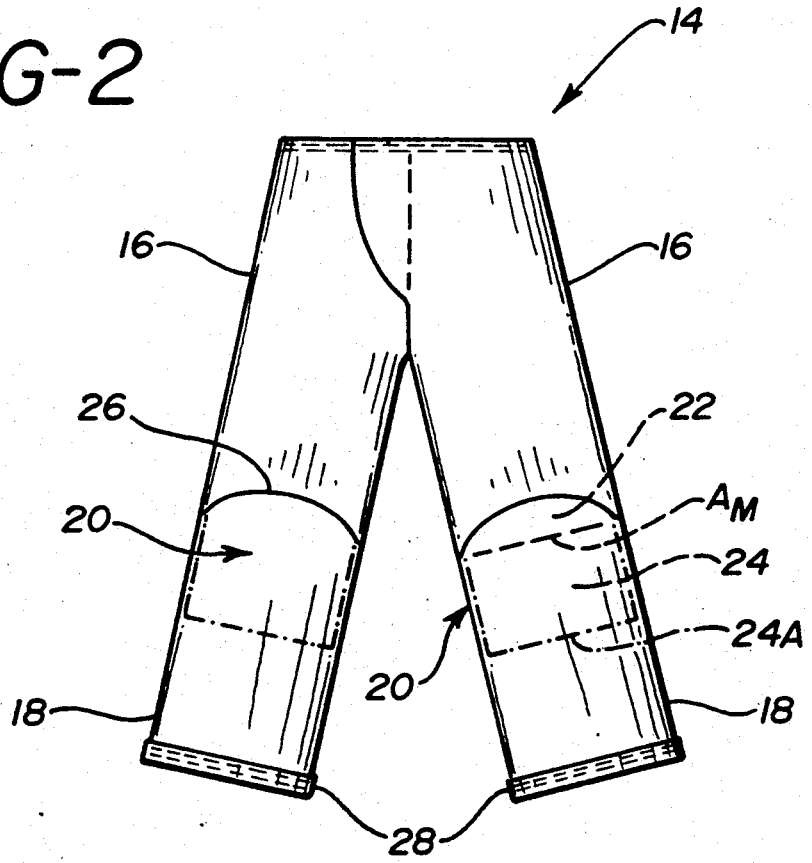
FIG. 2 is a front view of a pair of firefighter's turnout pants with pant legs in accordance with the present invention.
Figure 3:
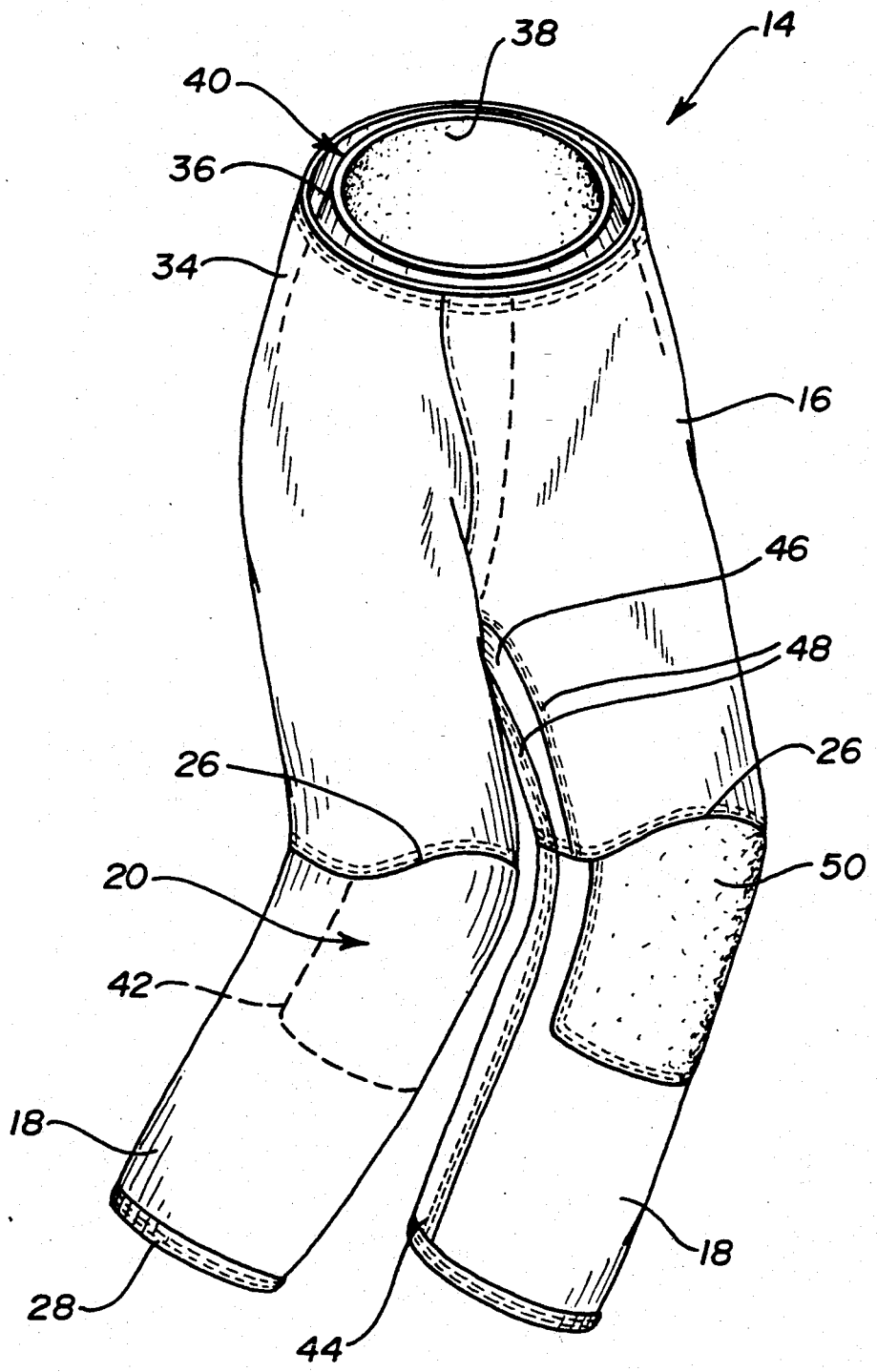
FIG. 3 is a perspective view of a pair of firefighter's turnout pants with pant legs in accordance with the present invention.
Figure 4:
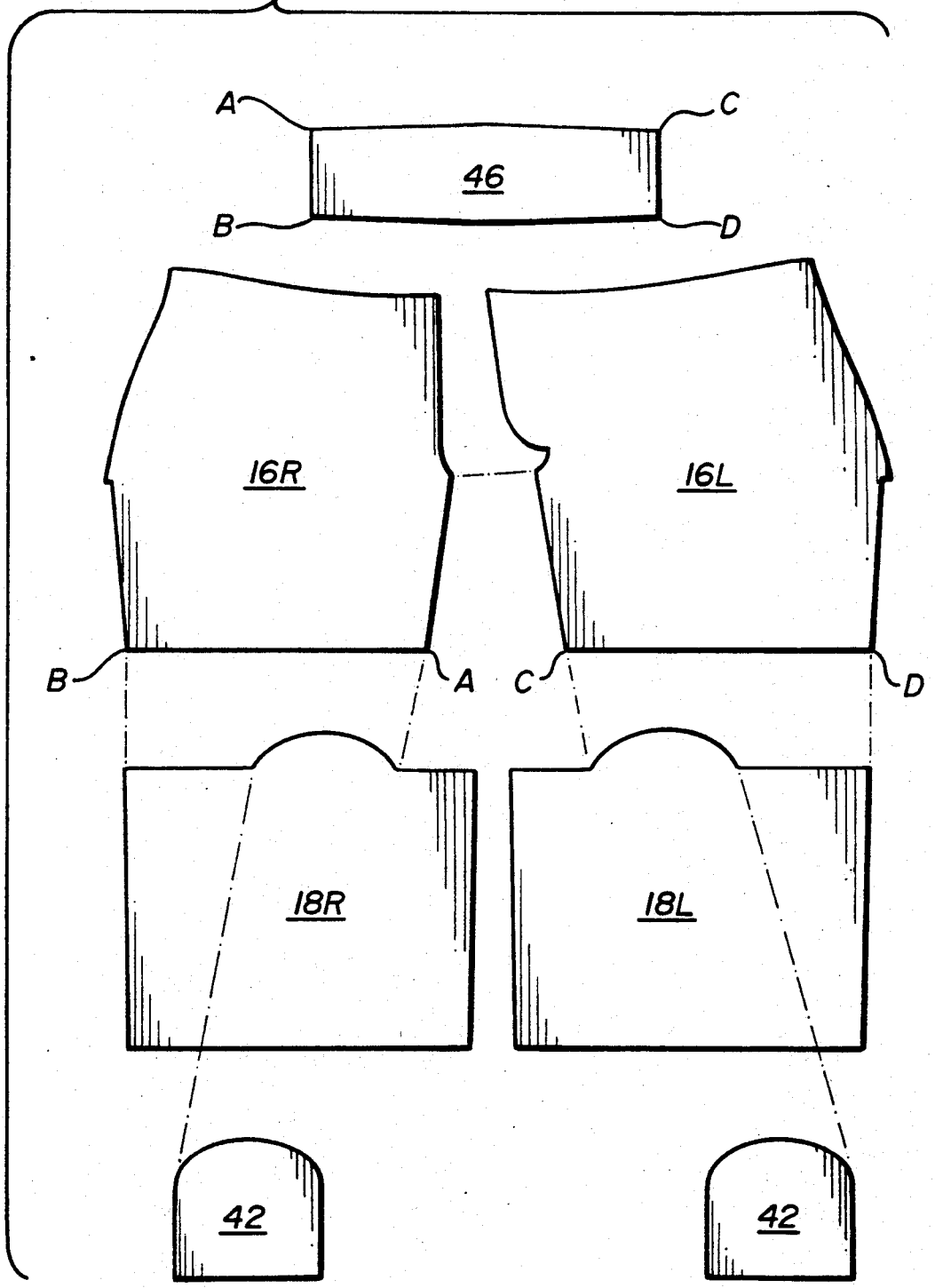
FIG. 4 is an exploded view of the patterns required to produce the knee bellows in the firefighter's turnout pants shown in FIGS. 2 and 3.

Referring now to the drawings, FIG. 1 shows a side view of typical prior art firefighter's turnout pants 10 which provide excellent protection when the firefighter's legs are straight. Typically, firefighter's turnout pants 10 comprise a waist portion and two full length leg portions 12 formed as straight cylinders from single pieces of material. FIGS. 2 and 3 are front and perspective views, respectively, of a pair of firefighter's turnout pants 14 made in accordance with the present invention. The patterns required to produce the present invention are shown in FIG. 4. The present invention provides improvements in firefighter's turnout pants 14 which permit cost-effective manufacturing of a bellows 20 therein to permit greater joint flexibility and protection during joint flexion and compression, while decreasing the effort needed to flex joints when wearing turnout pants 14

In accordance with the present invention, each leg portion is made from substantially two pieces, an upper leg portion 16 and a lower leg portion 18, seamed together above the knee, where the bellows 20 is provided integral with the lower leg section 18. The oversized bellows 20 results from the combination and seaming of patterns disclosed herein in FIG. 4. Referring to FIG. 2, the knee joint bellows 20 is defined in the lower leg section 18 by a dashed-dot line. Descriptively, the preferred embodiment of bellows 20 is defined as an area including a semi-elliptical upper portion 22 continuous with a generally rectangular lower portion 24 in the knee region, as indicated by a dashed line. The dashed line also generally indicates the major axis $A_M$ of the semi-elliptical upper portion 22 which extends generally around the front knee joint area.

As shown in FIG. 3, the bellows 20 of the present invention is oversized and adds a more natural shape to the knee joint region by producing a slight bend in these regions. This slight bend permits the knee joint region to be flexed without substantially tightening the material across the outside of the joints or bunching up the material at the inside of the joints, and also without reducing the thermal protection barrier in those regions.

Referring to both FIGS. 2 and 3, the bellows 20 extend side to side, approximately halfway around the leg across the front or outside of the knee joint and a portion of the lower leg. The bellows 20, thus, cover approximately the front half of the total knee joint area and a portion of the front of the lower leg. The bellows 20 are wider at the middle to eliminate pulling and tightness at the front, and narrower along the sides to reduce material bunching at the sides and back. A radial seam 26 along the upper edge of the semi-elliptical portion 22 of the bellows 20 provides a gusset that the knee falls into when the knee joint is flexed. The bottom "edge" 24A of the generally rectangular portion 24 of the bellows 20 is positioned well below the knee to permit crawling, climbing and bending without interference from the seam, but sufficiently above the cuff 28 to prevent cuff travel.

Preferably, the oversized bellows 20 has a maximum height of approximately 10 inches from the apex of the semi-elliptically shaped portion 22 to the bottom of the generally rectangularly shaped portion 24, and has a width of approximately 11 inches along the bottom edge 24A of the generally rectangularly shaped portion 24. The bellows 20 further preferably have a height of approximately 7 inches at the sides of the generally rectangular portion 24. The bellows 20 preferably provide not less than an additional 1½ of material to receive the apex of the knee. The bellows 20 thereby produces slight bends in the legs of the turnout pants 14 at the knees, reducing material tightness without effecting thermal protection when the knees are flexed.

The bellows 20 of the present invention results from the combination and seaming of patterns shown in FIG. 4. As shown in FIG. 4, the patterns for the upper and lower leg portions 16, 18 of the pants 14 include suffixes L and R, respectively, indicating the left and right pant legs to which they relate, respectively. The description which follows, while relating to the left pant leg, applies similarly to the construction of the bellows 20 of the right pant leg. The pattern 18L is rolled and the opposite side edges seamed to form an inseam 44 for the lower leg portion 18, shown best in FIG. 3. The pattern 16L for the upper leg portion 16 is seamed to the top edge of pattern 18L beginning at point D. The seam extends along the top edge of the semi-elliptical portion 22 of the bellows 20 to point C, forming radial seam 26. Crotch strip 46 connects to the pattern 16L to complete the left upper leg portion 16 with a pair of inseams 48 beginning at points C and D, and extending upward.

As shown in FIG. 3, the end CD of crotch strip 46 further connects to the left lower leg portion 18. The combination and seaming of the patterns 16L and 18L forms bellows 20 which produces a slight natural bend in the left pant leg. Thus, only a single inseam 44 and a single lateral seam, including radial seam 26, is required to form the bellows 20 from substantially two pieces of material, thereby eliminating further cutting and seaming, and reducing manufacturing costs required to form the bellows 20 Similar assembly of patterns 16R and 18R form the bellows 20 of the right pant leg. The pants 14 are completed when the remaining portion of crotch strip 46 connects to the pattern 16R at points A and B to complete the cylinder of the right upper leg portion 16, and the end AB of crotch strip 46 further connects to the right lower leg portion 18.

Shown in FIG. 3, the turnout pants 14 of the present invention include at least three layers including an outer flame and heat resistant layer 34, a moisture barrier layer 36, and an inner thermal barrier layer 38. The bellows 20 is constructed with extra material in all layers of the turnout pants 14, and is preferably continuous with all layers of the lower leg section 18. Preferably, the moisture barrier layer 36 and inner thermal barrier layer 38 are provided as an inner liner 40, removably attached to the outer layer for cleaning and maintenance. Regardless, the bellows 20 is provided in all layers, and thereby substantially reduces the tightness on the outside of the knee joints, and the compression in all layers when the joints are flexed.

The preferred embodiment of the present invention also includes an additional layer 42 of thermal barrier material in the area of the bellows 20 for added thermal protection. Having substantially the same size as the bellows 20, the additional thermal barrier layer 42 is shown in phantom in the right pant leg in FIG. 3. The oversized character of the bellows 20 allows this additional thermal barrier layer 42 to be added between the existing moisture barrier layer 36 and the existing thermal barrier layer 38, without causing tightness on the outside of the knee joint, or bunching up of material at the inside of the knee joint.

The pattern for the thermal barrier layer 42 is identical for the left and right legs, as shown in FIG. 4. The additional thermal protection layer 42 in the bellows 20 provides added thermal protection to the knee when the firefighter is standing and, in particular, when the bellows 20 is compressed by the knee joint, as for example, when the firefighter is crawling. This additional thermal protection layer 42 further provides added shock and impact protection to the knee joint, again, particularly when the bellows is compressed, as when a firefighter is crawling.

In addition, an oversized, generally semi-elliptically shaped patch 50, having substantially the same dimensions as the bellows 20, may be attached over the area of each bellows 20 as an additional, outside layer of the bellows 20 to extend the wear life and reduce compression burns. Patch 50 has substantially the same shape as the additional thermal barrier layer 42 shown in FIG. 4. Shown representatively in FIG. 3 on the left lower leg portion 18, the patch 50 also provides additional padding for shock or impact resistance, and may be made either of leather, which is preferred, or may be made of same material as the outer flame and heat resistant layer 34 the pants 14.

Having described the invention in detail and by reference to preferred embodiments thereof, it will be apparent that modifications and variations are possible without departing from the scope of the invention which is defined in the appended claims.

What is claimed is:

1. Firefighter's turnout pants comprising a lower body portion including full length pant legs, each pant leg having:

a front knee joint area, and continuous therewith, a lower leg section extending below and to at least one side of at least a portion of said front knee joint area wherein said lower leg section has an upper edge and a lower edge; and an upper leg section extending above said front knee joint area;

wherein said front knee joint area comprises an oversized bellows connecting to said upper leg section of each pant leg just above said bellows, each of said bellows comprising a generally semi-elliptically shaped portion having a major axis extending generally around the front knee joint area and a generally rectangularly shaped portion extending downward and continuous therewith, said bellows extending generally around the front portions of said knee joint areas and portions of the front of the lower legs to provide increased protection for the wearer of the apparel and increased flexion range for the knee joint areas of the turnout pants.

2. Firefighter's turnout pants as claimed in claim 1 wherein said bellows are positioned to supply increased thermal protection and flexion range to the knee joint areas of the turnout pants by providing extra material in the front knee joint area which produces a slight natural bend in the turnout pants at the knee joint areas and reduces tightness and compression of the knee joint areas.

3. Firefighter's turnout pants as claimed in claim 2 wherein said generally semi-elliptically shaped portions of said bellows connect to said upper leg sections along radial seams.

4. Firefighter's turnout pants as claimed in claim 3 wherein said lower leg sections, continuous with said bellows, connect to themselves along generally straight inseams, and the upper edge of said lower leg section adjacent to said radial seam connects to said upper leg sections along generally straight seams.

5. Firefighter's turnout pants as claimed in claim 2 wherein said front knee joint area is generally positioned at least 10 inches above the lower edge of said lower leg sections.

6. Firefighter's turnout pants as claimed in claim 1 wherein said bellows are covered by oversized, generally semi-elliptically shaped patches extending generally across said front knee joint areas and portions of the front of said lower legs.

7. Firefighter's turnout pants as claimed in claim 6 wherein said patches are constructed of leather to extend the wear life thereof, and reduce compression burns.

8. Firefighter's turnout pants as claimed in claim 1 wherein said bellows at said front knee joint area is defined as having a maximum height at the apex of said semi-elliptically shaped portion to the bottom of said generally rectangularly shaped portion of approximately 10 inches, having a width of approximately 11 inches along the bottom edge of said rectangularly shaped portion, and having a height of approximately 7 inches at the sides of said semi-elliptically shaped portion.

9. Firefighter's turnout pants as claimed in claim 1 wherein each of said bellows further comprises two heat resistant layers disposed in said knee joint areas.

10. Firefighter's turnout pants comprising a lower body portion including full length pant legs, each pant leg having:

a front knee joint area, and continuous therewith, a lower leg section extending below and to at least one side of at least a portion of said front knee joint area;

an upper leg section extending above said front knee joint area;

wherein said front knee joint area comprises an oversized bellows connecting to said upper leg section of each pant leg, each of said bellows comprising a generally semi-elliptically shaped portion having a major axis extending generally around the front knee joint area and a generally rectangularly shaped portion extending downward and continuous therewith, said bellows extending generally around the front portions of said knee joint areas and portions of the front of the lower legs to provide increased protection for the wearer of the apparel and increased flexion range for the knee joint areas of the turnout pants;

wherein each of said pants legs includes an outer flame and heat resistant layer, an intermediate moisture barrier layer, and an inner heat resistant layer;

wherein said bellows include an outer flame and heat resistant layer, an intermediate moisture barrier layer, and an inner heat resistant layer connected to corresponding layers of said pants legs; and wherein each of said bellows further comprises a second heat resistant layer disposed in said knee joint areas between said intermediate moisture barrier layer and said inner heat resistant layer.

11. Firefighter's turnout pants comprising a lower body portion including full length pant legs, each pant leg having:

a knee joint area, and continuous therewith, a lower leg section extending below and to at least one side of at least a portion of said knee joint area; and an upper leg section extending above said knee joint area;

wherein said knee joint area comprises an oversized bellows connecting to said upper leg section of each pant leg just above said bellows, each of said bellows extending across approximately one half of said knee joint area, and including a generally semi-elliptically shaped portion and a generally rectangularly shaped portion continuous therewith, said bellow further being enlarged in its dimensions which extend across said knee joint area and positioned to receive the knee of the wearer;

whereby firefighters wearing said turnout pants are provided with increased protection and increased flexion range for the knee joint areas of the turnout pants.

12. Firefighter's turnout pants comprising a lower body portion including full length pant legs, each pant leg having:

a knee joint area, and continuous therewith, a lower leg section extending below and to at least one side of at least a portion of said knee joint area; and an upper leg section extending above said knee joint area;

wherein said knee joint area comprises an oversized bellows connecting to said upper leg section of each pant leg, each of said bellows extending across approximately one half of said knee joint area, and including a generally semi-elliptically shaped portion and a generally rectangularly shaped portion continuous therewith, said bellow further being enlarged in its dimensions which extend across said knee joint area and positioned to receive the knee of the wearer;

wherein each of said bellows and said lower leg sections continuous therewith, comprise three continuous layers including an outer flame and heat resistant layer, an intermediate moisture barrier layer, and an inner heat resistant layer;

whereby firefighters wearing said turnout pants are provided with increased protection and increased flexion range for the knee joint areas of the turnout pants.

13. Firefighter's turnout pants as claimed in claim 11 wherein said generally semi-elliptically shaped portions of said bellows connect to said upper leg sections along radial seams, and are positioned to supply increased thermal protection and flexion range to the knee joint areas of the turnout pants by providing extra material in the front knee joint area, thereby producing a slight natural bend in the turnout pants at the knee joint areas and reducing tightness and compression of the knee joint areas.

14. Firefighter's turnout pants as claimed in claim 1 wherein said upper leg section and said continuous front knee joint area and lower leg section form an angle where said bellows connects to said upper leg section.

15. Firefighter's turnout pants as claimed in claim 11 wherein said upper leg section and said continuous knee joint area and lower leg section form an angle where said bellow connects to said upper leg section.

16. Firefighter's turnout pants as claimed in claim 1 wherein:

each of said pants legs includes an outer flame and heat resistant layer, an intermediate moisture barrier layer, and an inner heat resistant layer;

said bellows include an outer flame and heat resistant layer, an intermediate moisture barrier layer, and an inner heat resistant layer connected to corresponding layers of said pants legs; and each of said bellows further comprises a second heat resistant layer disposed in said knee joint areas between said intermediate moisture barrier layer and said inner heat resistant layer.

17. Firefighter's turnout pants as claimed in claim 11 wherein:

each of said bellows and said lower leg sections continuous therewith, comprise three continuous layers including an outer flame and heat resistant layer, an intermediate moisture barrier layer, and an inner heat resistant layers; and said bellows further includes a second heat resistant layer disposed between said intermediate moisture barrier layer and said inner heat resistant layer.

* * * * *

UNITED STATES PATENT AND TRADEMARK OFFICE

CERTIFICATE OF CORRECTION

PATENT NO. : 5,219,367
DATED : June 15, 1993
INVENTOR(S) : Ronald L. Fields

It is certified that error appears in the above-indentified patent and that said Letters Patent is hereby corrected as shown below:

Col. 8, Line 35, "layer;" should be
--layer; and--.
Col. 8, Line 35, the following paragraph was omitted
--wherein said bellows further includes a second heat resistant layer disposed between said intermediate moisture barrier layer and said inner heat resistant layer;--
Col. 8, Line 57, "said bellow" should be
--said bellows--.

Signed and Sealed this

Twenty-second Day of February, 1994

*Attest:*

Bruce Lehman

BRUCE LEHMAN

*Attesting Officer*

*Commissioner of Patents and Trademarks*